US009076405B2

(12) United States Patent
Yanagi et al.

(10) Patent No.: US 9,076,405 B2
(45) Date of Patent: Jul. 7, 2015

(54) DISPLAY DEVICE, METHOD FOR DRIVING SAME, AND LIQUID CRYSTAL DISPLAY DEVICE

(75) Inventors: Toshihiro Yanagi, Osaka (JP); Kohji Saitoh, Osaka (JP); Masami Ozaki, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 338 days.

(21) Appl. No.: 13/581,538

(22) PCT Filed: Dec. 13, 2010

(86) PCT No.: PCT/JP2010/072383

§ 371 (c)(1),
(2), (4) Date: Aug. 28, 2012

(87) PCT Pub. No.: WO2011/108166

PCT Pub. Date: Sep. 9, 2011

(65) Prior Publication Data

US 2013/0009935 A1 Jan. 10, 2013

(30) Foreign Application Priority Data

Mar. 3, 2010 (JP) ..... 2010-046789

(51) Int. Cl.
*G09G 5/00* (2006.01)
*G09G 3/36* (2006.01)

(52) U.S. Cl.
CPC ..... *G09G 3/3688* (2013.01); *G09G 2310/0291* (2013.01); *G09G 2320/0261* (2013.01); *G09G 2330/021* (2013.01)

(58) Field of Classification Search
CPC ..... G09G 5/006; G09G 2330/021; G09G 2310/027; G09G 3/3233; G09G 3/3611; G09G 3/3614; G09G 3/3648; G09G 3/3655; G09G 3/3688; G09G 3/3696
USPC ..... 345/87, 98, 204, 211, 212
See application file for complete search history.

(56) References Cited

U.S. PATENT DOCUMENTS 5,307,212 A * 4/1994 Tagiri ..... 386/287
5,798,747 A 8/1998 Moraveji (Continued)

FOREIGN PATENT DOCUMENTS

JP 2001312253 A 11/2001
JP 2002/182619 A 6/2002

(Continued)

OTHER PUBLICATIONS

International Search Report PCT/ISA/210 for International Application No. PCT/JP2010/072383 dated Feb. 7, 2011.

(Continued)

*Primary Examiner* — Joe H Cheng
(74) *Attorney, Agent, or Firm* — Harness, Dickey & Pierce

(57) ABSTRACT

A display device includes a signal line drive circuit provided with an analog amplifier through which a stationary electric current flows. The display device further includes a control signal output section which suspends operation of the analog amplifier during a period (non-scanning period) from an start time after application to a data signal line S(i) of a voltage necessary for display is completed in a horizontal period to an end time in the horizontal period. The control signal output section sustains an AMP_Enable signal through which the analog amplifier is controlled at an L value (a low value) in the non-scanning period. As a result, stationary electric current flowing through the analog amplifier is cut off in the non-scanning period. According to this, the display device allows for reduction of electric power consumption while being capable of displaying a moving image without causing flickering.

12 Claims, 10 Drawing Sheets

(56) References Cited

U.S. PATENT DOCUMENTS

| | | | | |
|---|---|---|---|---|
| 7,321,353 | B2 | 1/2008 | Tsuda et al. | |
| 2002/0018059 | A1* | 2/2002 | Yanagi et al. | 345/204 |
| 2002/0093475 | A1 | 7/2002 | Hashimoto | |
| 2002/0180673 | A1 | 12/2002 | Tsuda et al. | |
| 2003/0048669 | A1* | 3/2003 | Abe | 365/189.09 |
| 2004/0041763 | A1* | 3/2004 | Kodama et al. | 345/87 |
| 2004/0056833 | A1* | 3/2004 | Kitagawa et al. | 345/92 |
| 2005/0122303 | A1 | 6/2005 | Hashimoto | |
| 2005/0140632 | A1 | 6/2005 | Tsuda et al. | |
| 2006/0061532 | A1 | 3/2006 | Hashimoto | |
| 2007/0001978 | A1 | 1/2007 | Cho | |
| 2008/0079683 | A1 | 4/2008 | Hashimoto | |
| 2008/0186267 | A1 | 8/2008 | Mamba et al. | |
| 2008/0218500 | A1 | 9/2008 | Akai et al. | |
| 2008/0297500 | A1* | 12/2008 | Kato | 345/212 |
| 2009/0243496 | A1* | 10/2009 | Lee et al. | 315/158 |
| 2011/0157112 | A1* | 6/2011 | Shibata et al. | 345/205 |
| 2013/0050146 | A1* | 2/2013 | Saitoh et al. | 345/174 |
| 2014/0009459 | A1* | 1/2014 | Nakata et al. | 345/212 |

FOREIGN PATENT DOCUMENTS

| | | | |
|---|---|---|---|
| JP | 2002215108 | A | 7/2002 |
| JP | 2003330429 | A | 11/2003 |
| JP | 2005165102 | A | 6/2005 |
| JP | 2008040195 | A | 2/2008 |
| JP | 2008176159 | A | 7/2008 |
| JP | 2008224798 | A | 9/2008 |
| JP | 2009216853 | A | 9/2009 |

OTHER PUBLICATIONS

Search Report for corresponding European Application No. 10847062.6 dated Mar. 20, 2015.

* cited by examiner

DISPLAY DEVICE, METHOD FOR DRIVING SAME, AND LIQUID CRYSTAL DISPLAY DEVICE

TECHNICAL FIELD

The present invention relates to a display device, a method of driving the display device, and a liquid crystal display device which allow for reduction of electric power consumption.

BACKGROUND ART

Thin, lightweight, and low electric power-consuming display devices have been used in various applications recently. A typical example of such a device is a liquid crystal display device. Those devices are particularly found in mobile phones, smartphones, and laptop personal computers. It is predicted that electronic paper, which is a display device having a smaller thickness, will be rapidly developed and used in a wide range of applications. A popularly acknowledged current issue under the circumstances is to reduce electric power consumption in various display devices.

Patent Literature 1 discloses a method of driving a display device capable of achieving low electric power consumption by specifying a suspension period (non-scanning period) which is longer than a scanning period for a single scanning of a frame and during which no scanning signal lines are scanned.

CITATION LIST

Patent Literature

Patent Literature 1
Japanese Patent Application Publication, Tokukai, No. 2001-312253A (Publication Date: Nov. 9, 2001)

SUMMARY OF INVENTION

Technical Problem

The technology described in Patent Literature 1 has the following problems. The technology of Patent Literature 1 achieves low electric power consumption by specifying a non-scanning period, i.e., a suspension period, which is longer than a scanning period. In other words, a non-scanning period which is longer than a scanning period needs to be specified in each vertical period. This translates into less frequent rewriting of frames per unit time. A refresh rate for each pixel therefore decreases. The decreasing refresh rate is highly likely to cause flickering on a screen, depending on properties of a display panel. In addition, a decreasing refresh rate means that fewer images can be displayed per second, so that smooth moving images cannot be reproduced. For example, the refresh rate is typically set to 60 Hz to rewrite images 60 times per second. Note here that, if the scanning period and the suspension period are set to 1 frame and 2 frames, respectively by using the technology of Patent Literature 1, the refresh rate is reduced to 20 Hz, which is one third of the typical refresh rate. That is, rewriting images only 20 times per second causes moving image display with frame dropping. The technology of Patent Literature 1 has difficulty, especially, in displaying moving images.

The present invention has been made in view of the problems, and an object of the present invention is to provide a display device, a method of driving the display device, and a liquid crystal display device which allow for reduction of electric power consumption while being capable of displaying a moving image without causing flickering.

Solution to Problem

In order to attain the object, a display device in accordance with the present invention includes: a signal line drive circuit provided with a circuit through which a stationary electric current flows; and capability control means for lowering capability of the circuit through which the stationary electric current flows, during a period from a start time after application to at least one data signal line of a voltage necessary for display is completed in a horizontal period to an end time in the horizontal period.

According to the arrangement, the circuit through which the stationary electric current flows is in the low capability state during the period (hereinafter referred to as a non-scanning period) from the start time to the end time in the horizontal period. This allows cut-off of the stationary electric current that flows through the circuit through which the stationary electric current flows. As a result, the signal line drive circuit is smaller in average electric current consumption than a conventional signal line drive circuit. Accordingly, the display device can achieve lower electric power consumption than a conventional display device.

According to the display device, a period in which capability of the circuit through which the stationary electric current flows is lowered is completed in the horizontal period. Specifically, the display device causes the circuit through which the stationary electric current flows to be in a normal condition (an operating condition) in each horizontal period without fail, so as to supply the voltage necessary for display to the at least one data signal line. This causes a refresh period of each pixel to be equal to one (1) frame period. In other words, an image is displayed in all the frame periods.

Accordingly, the display device of the present invention can yield an effect of allowing for reduction of electric power consumption while being capable of displaying a moving image without causing flickering.

In order to attain the object, a method in accordance with the present invention of driving a display device including a signal line drive circuit provided with a circuit through which a stationary electric current flows, the method includes the capability control step of lowering capability of the circuit through which the stationary electric current flows, during a period from a start time after application to at least one data signal line of a voltage necessary for display is completed in a horizontal period to an end time in the horizontal period.

The arrangement yields an operation effect which is identical to that yielded by the display device in accordance with the present invention.

It is preferable that, from the start time to the end time, the capability control means suspend the circuit through which the stationary electric current flows.

The arrangement allows for further reduction of electric power consumption.

For a fuller understanding of the nature and advantages of the invention, reference should be made to the ensuing detailed description taken in conjunction with the accompanying drawings.

Advantageous Effects of Invention

A display device in accordance with the present invention yields an effect of allowing for reduction of electric power consumption while being capable of displaying a moving image without causing flickering.

Figure 3:
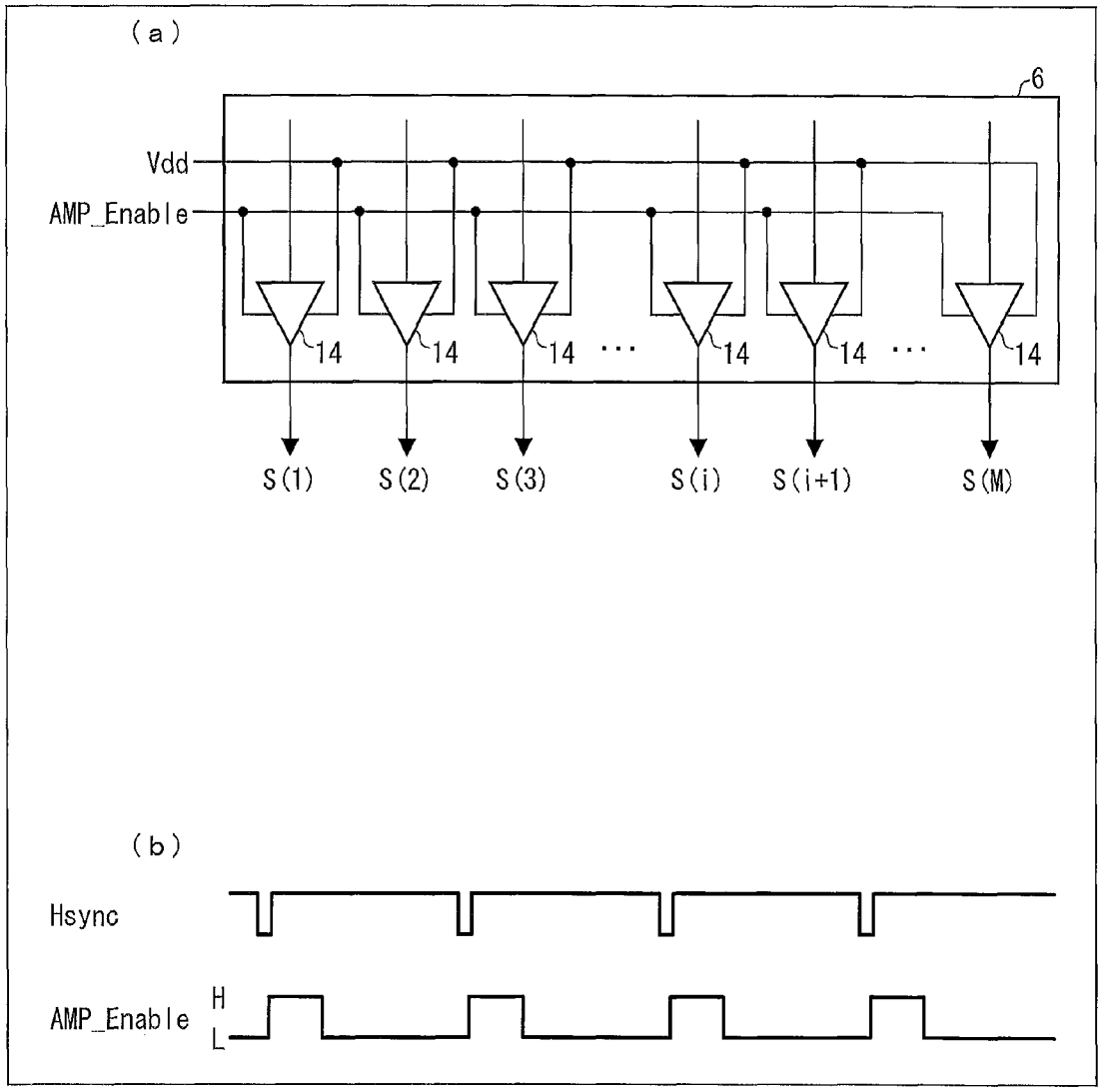

(a) of FIG. 3 shows an internal configuration, especially an output part of a signal line drive circuit. (b) of FIG. 3 shows a waveform of an AMP_Enable signal.

Figure 4:
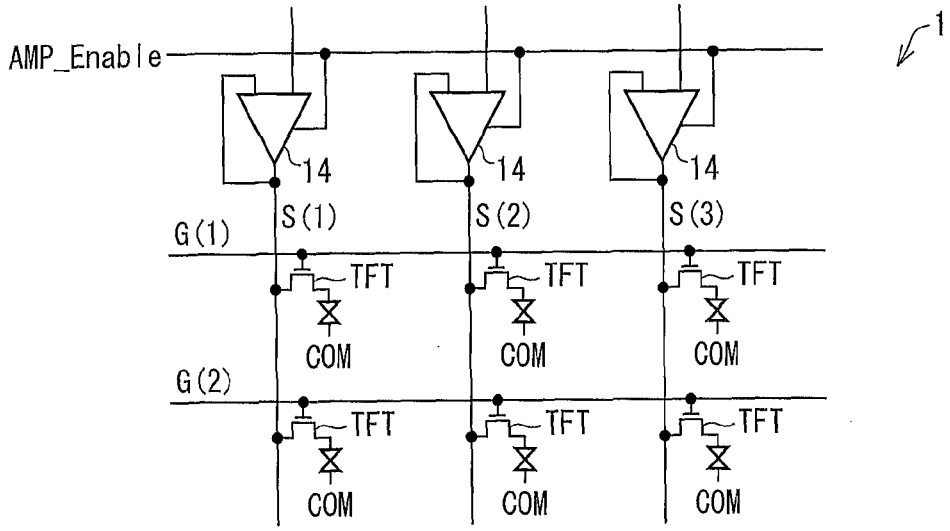

FIG. 4 briefly shows a circuit structure of a display panel.

Figure 5:
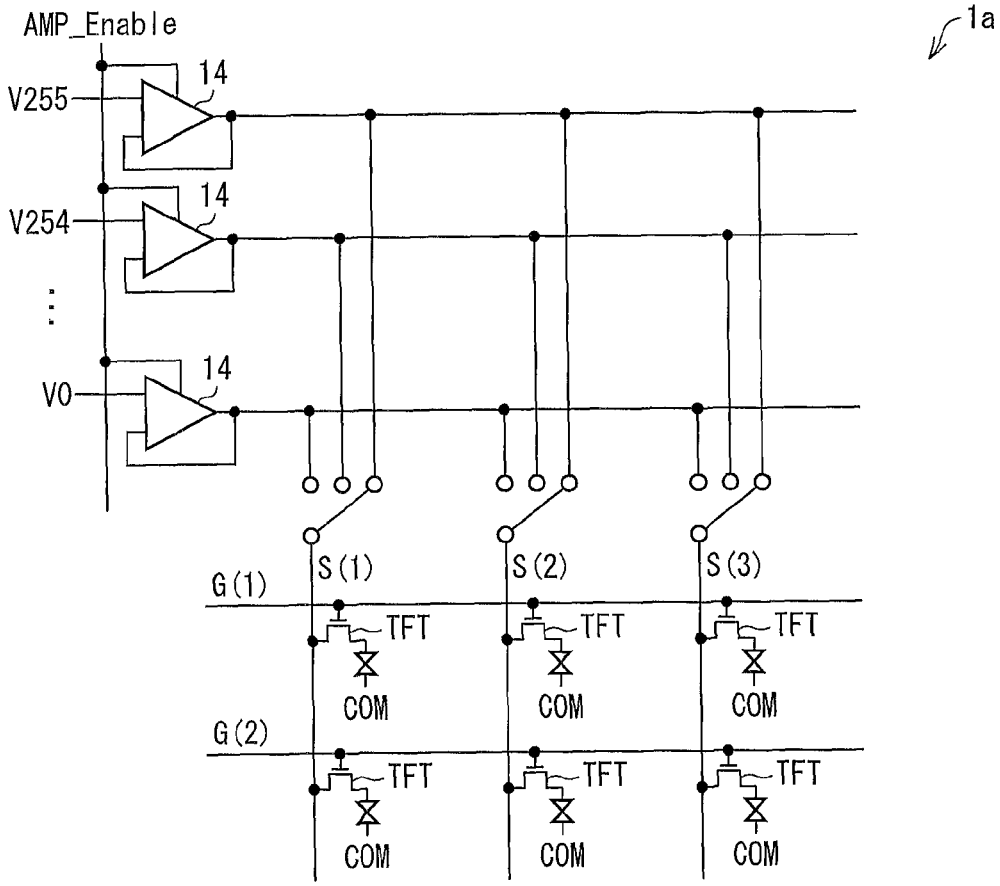

FIG. 5 partially shows an arrangement of a display device including analog amplifiers which are as many as gradations.

Figure 6:
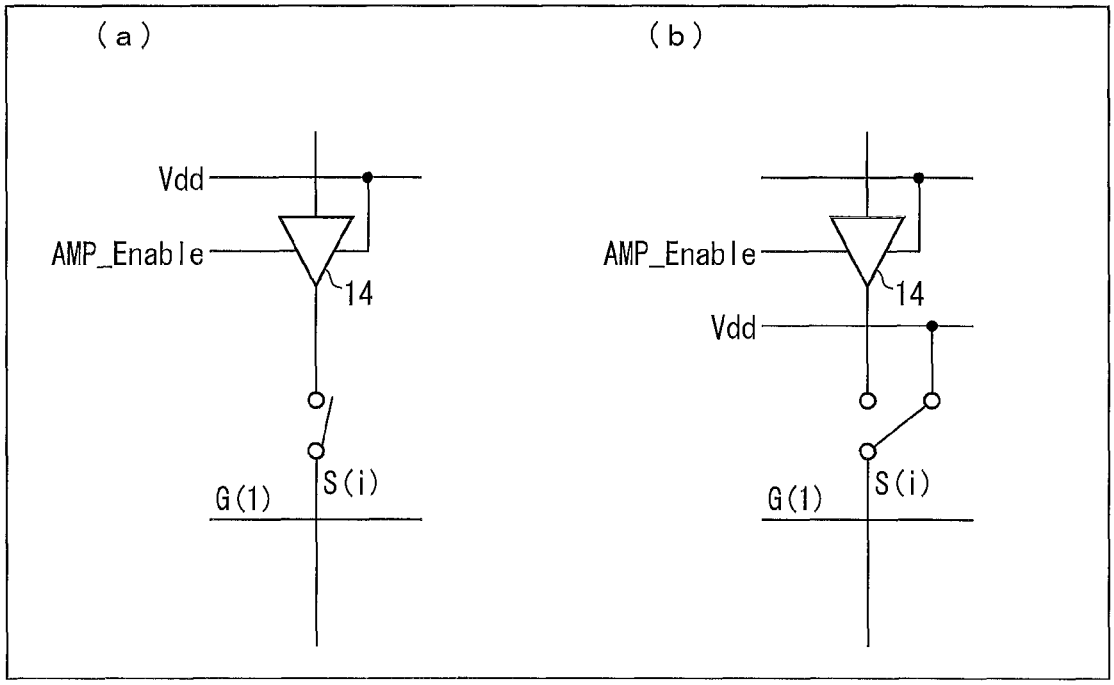

(a) of FIG. 6 shows a state in which a data signal line is electrically floating in a non-scanning period. (b) of FIG. 6 shows a state in which the data signal line is connected to the common voltage source in the non-scanning period.

Figure 7:
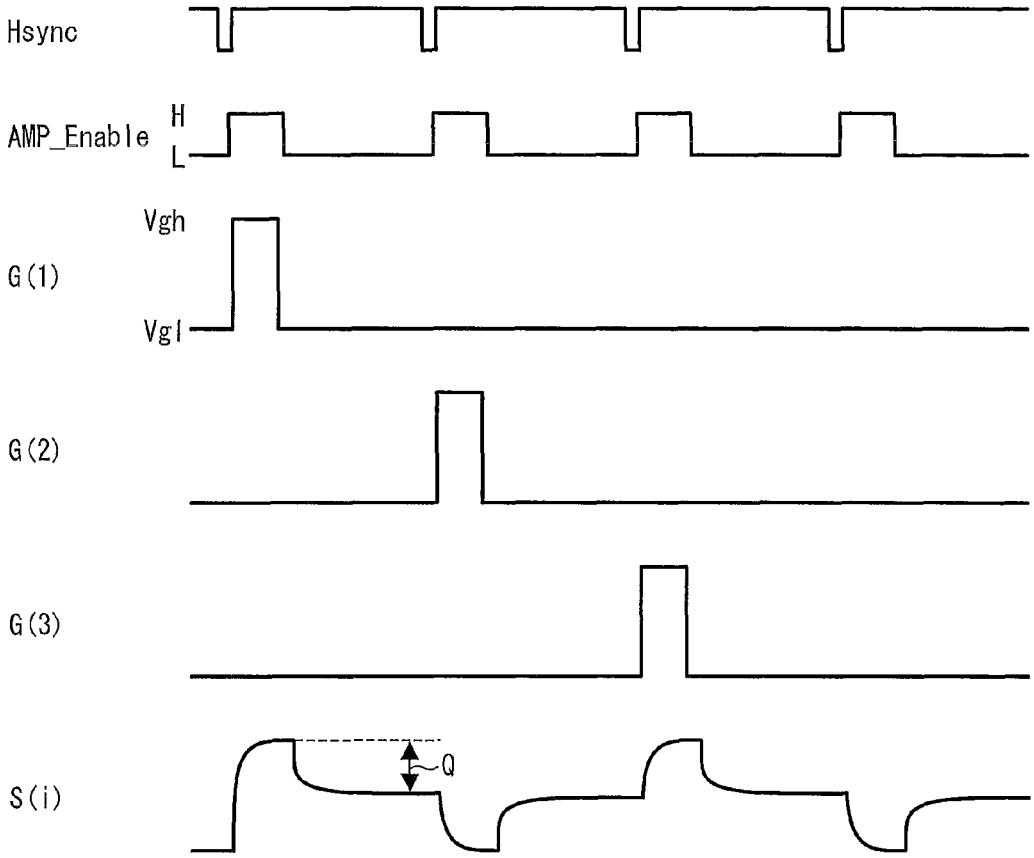

FIG. 7 shows waveforms of various signals in a case where the data signal line is connected to the common voltage source in the non-scanning period.

Figure 8:
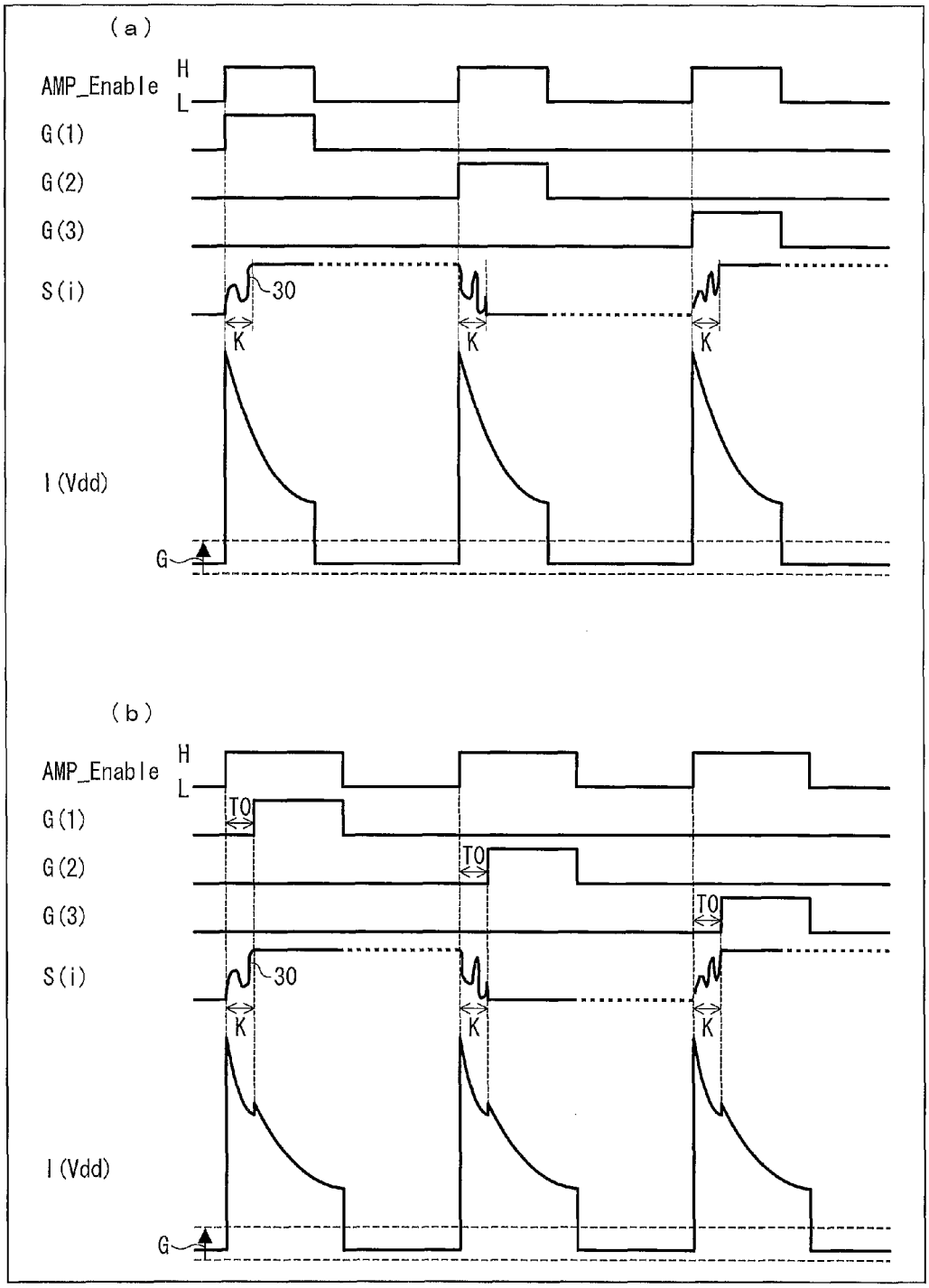

(a) of FIG. 8 shows waveforms of various signals in a case where a timing at which an analog amplifier is restored from a non-operating condition to an operating condition and a timing at which a gate of a TFT is turned on are identical. (b) of FIG. 8 shows waveforms of various signals in a case where the gate of the TFT is turned on at a timing later than the timing at which the analog amplifier is restored from the non-operating condition to the operating condition.

Figure 9:
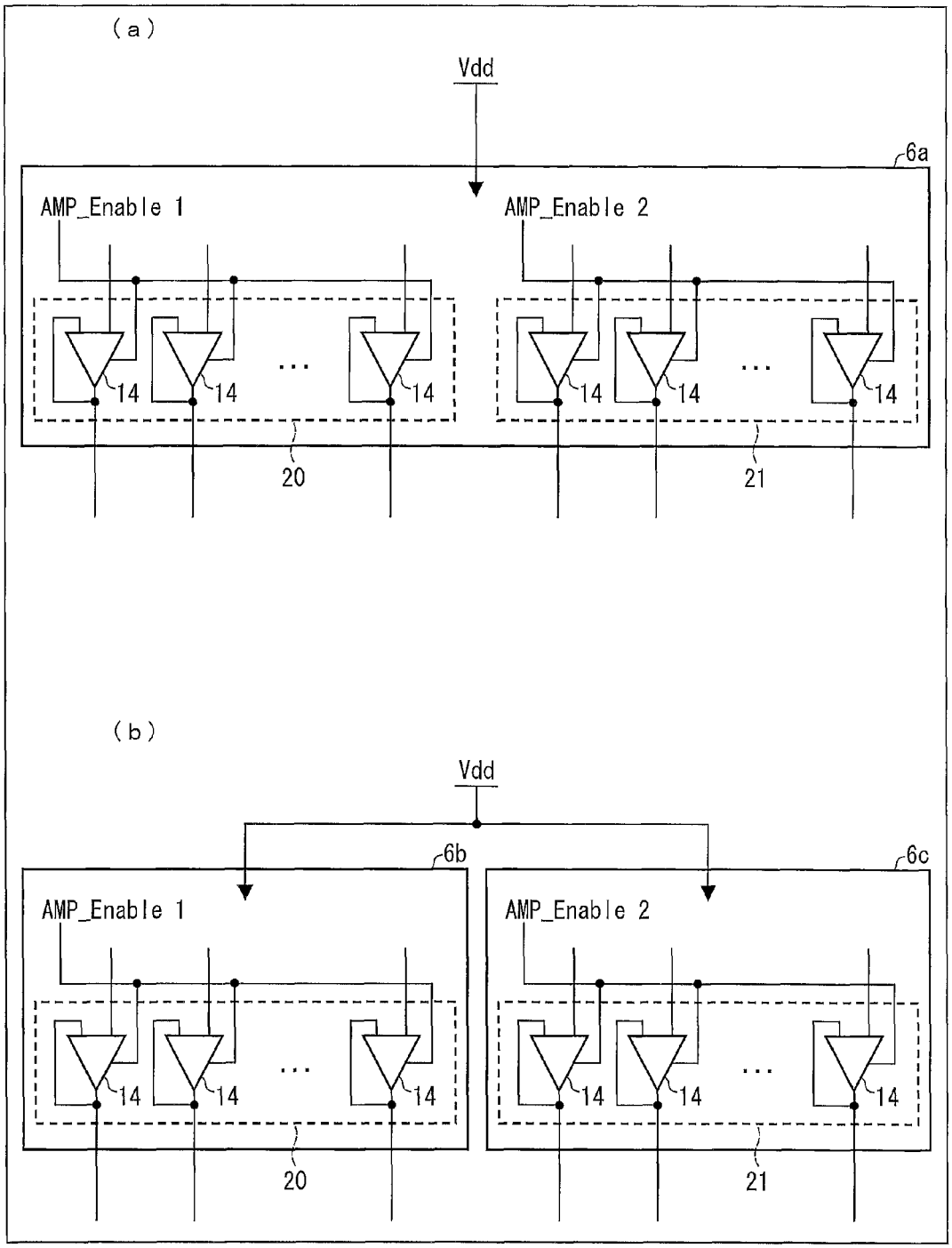

(a) of FIG. 9 shows a configuration of a signal line drive circuit including a first analog amplifier group made up of a plurality of analog amplifiers and a second analog amplifier group made up of a plurality of analog amplifiers. (b) of FIG. 9 shows a configuration of a first signal line drive circuit including the first analog amplifier group made up of the plurality of analog amplifiers and a configuration of a second signal line drive circuit including the second analog amplifier group made up of the plurality of analog amplifiers.

Figure 10:
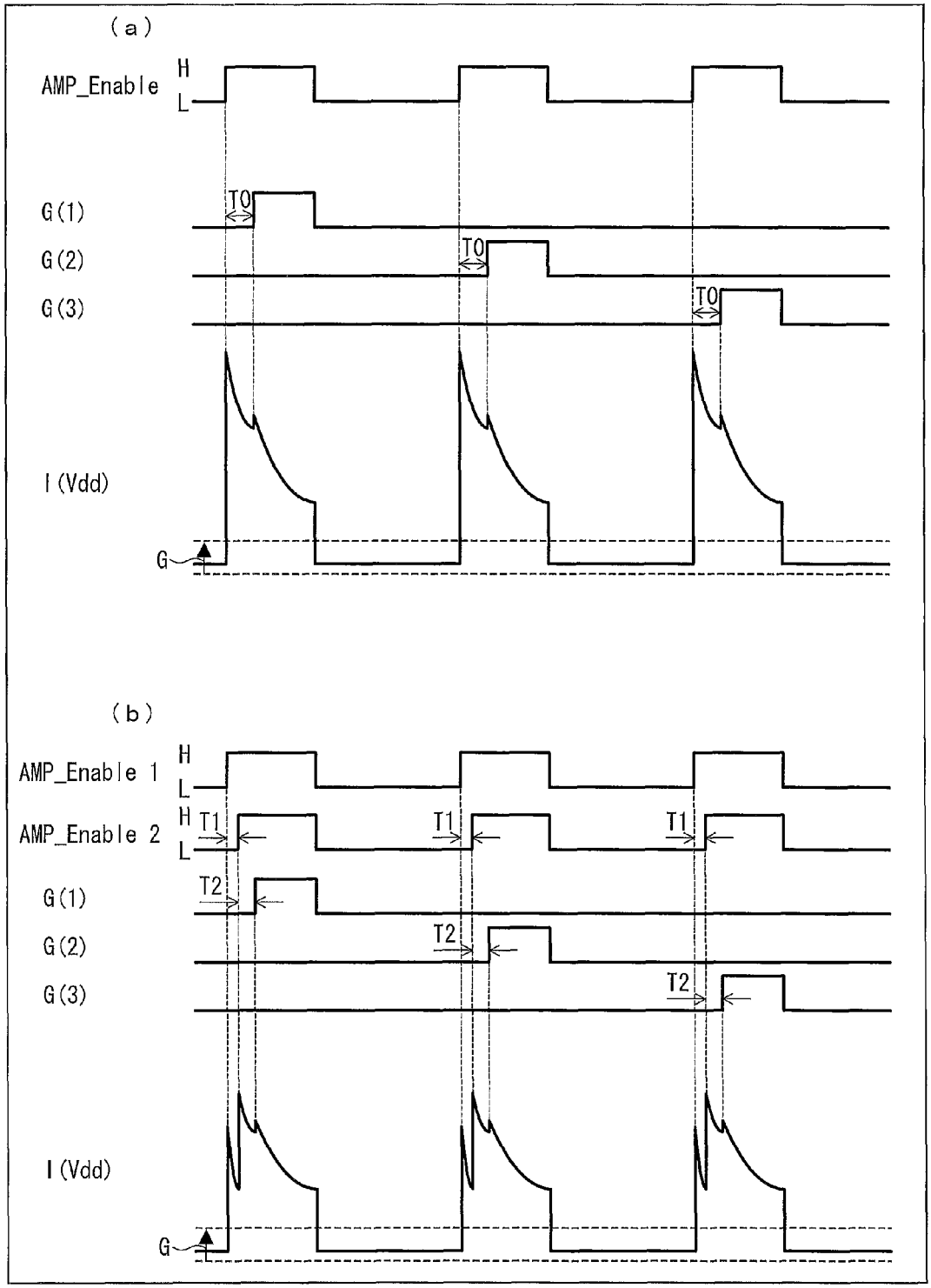

(a) of FIG. 10 shows waveforms of various signals in a case where all the analog amplifiers simultaneously switch from the non-operating condition to the operating condition. (b) of FIG. 10 shows waveforms of various signals in a case where a part of all the analog amplifiers switches from the non-operating condition to the operating condition at a timing different from a timing at which the remaining part of the analog amplifiers switches from the non-operating condition to the operating condition.

Figure 11:
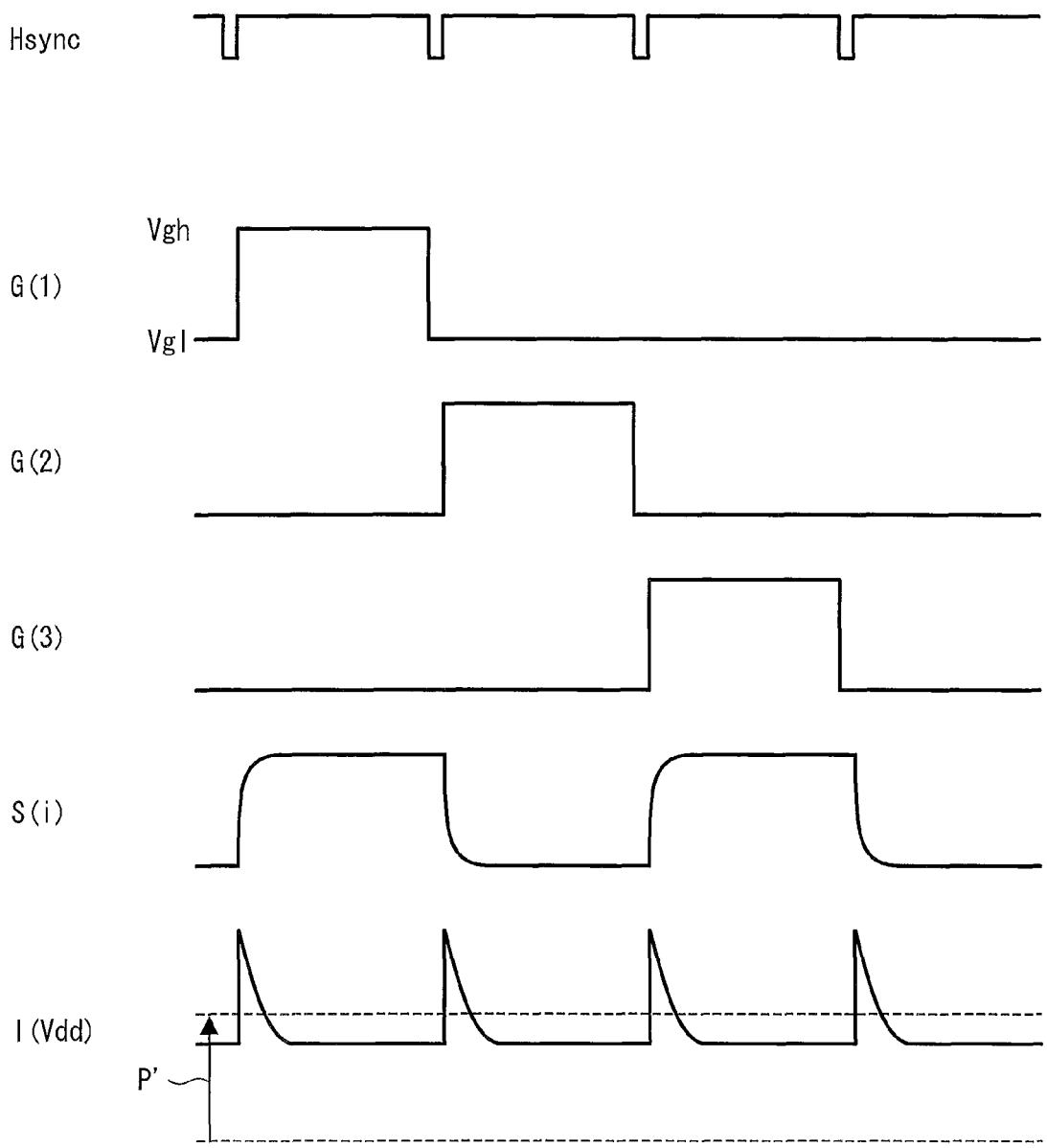

FIG. 11 shows signal waveforms during driving by a conventional display device of a display panel.

DESCRIPTION OF EMBODIMENTS

An embodiment in accordance with the present invention is described below with reference to FIG. 1 through FIG. 11.

(Arrangement of Display Device 1)

Figure 2:
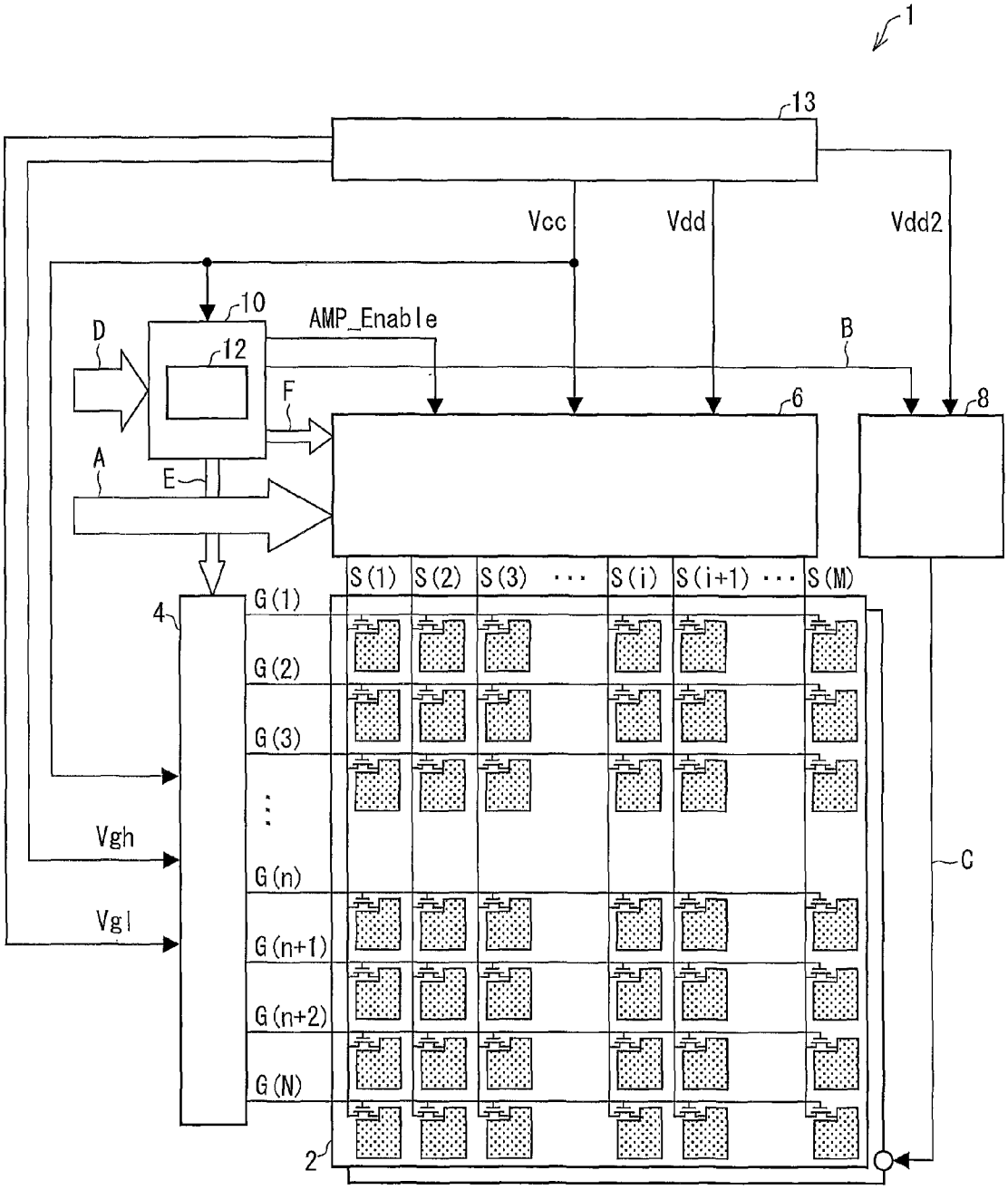
FIG. 2 shows an overall arrangement of a display device.

First, the following description discusses an arrangement of a display device (liquid crystal display device) 1 with reference to FIG. 2. FIG. 2 is an overall arrangement of the display device 1. The display device 1 includes a display panel 2, a scanning line drive circuit (gate driver) 4, a signal line drive circuit (source driver) 6, a common electrode drive circuit 8, a timing controller 10, and a voltage source generating circuit 13 (see FIG. 2). The timing controller 10 further includes a control signal output section (capability control means) 12.

The display panel 2 includes (i) a screen in which a plurality of pixels are provided in a matrix pattern, (ii) N (N is an integer) scanning signal lines G (gate lines) for scanning the screen by line-sequential selection, and (iii) M (M is an integer) data signal lines S (source lines) for supplying a data signal to each pixel in one (1) selected line (row). The scanning signal lines G and the data signal lines S intersect at right angles.

Figure 1:
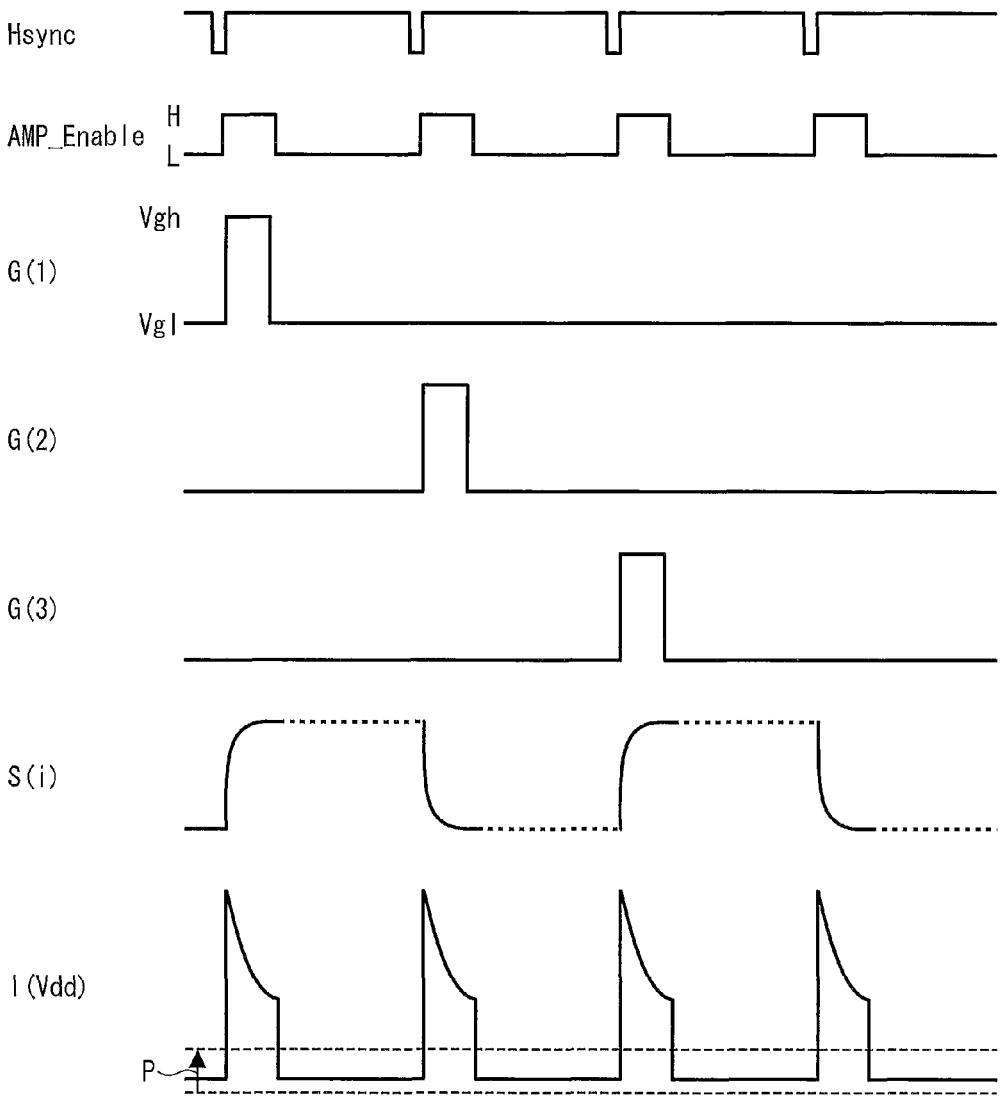
FIG. 1 shows waveforms of various signals during driving of a display panel of a display device in accordance with an embodiment of the present invention.

G (n) shown in FIG. 1 denotes the nth (n is an integer) scanning signal line G. For example, G (1) denotes the first scanning signal line G, G (2) denotes the second scanning signal line G, and G (3) denotes the third scanning signal line G. Meanwhile, S (i) shown in FIG. 1 denotes the ith (i is an integer) data signal line S. For example, S (1) denotes the first data signal line S, S (2) denotes the second data signal line S, and S (3) denotes the third data signal line S.

The scanning line drive circuit 4 line-sequentially scans the scanning signal lines G from an upper part toward a lower part of the screen. During the scanning, the scanning line drive circuit 4 supplies, to each of the scanning signal lines G, a rectangular wave for turning on a switching element (TFT) included in a pixel electrode and connected to a pixel electrode. This causes each pixel in one (1) row in the screen to be selected.

In accordance with a video signal (see an arrow A in FIG. 2) supplied to the signal line drive circuit 6, the signal line drive circuit 6 finds a voltage to be supplied to each pixel in one (1) selected row, and supplies the voltage thus found to each of the data signal lines S. As a result, image data is supplied to each pixel in a selected scanning signal line G.

The display device 1 includes a common electrode (not shown) provided for each pixel in the screen. In accordance with a signal (see an arrow B in FIG. 2) supplied from the timing controller 10, the common electrode drive circuit 8 supplies, to the common electrode, a given common voltage for driving the common electrode.

In accordance with a horizontal sync signal Hsync (see an arrow D in FIG. 2) supplied to the timing controller 10, the timing controller 10 supplies, to each of the circuits, a signal serving as a reference for causing the circuits to operate in sync with each other. Specifically, a gate start pulse signal and a gate clock signal are supplied to the scanning line drive circuit 4 (see an arrow E in FIG. 2). A source start pulse signal, a source latch strobe signal, and a source clock signal are supplied to the signal line drive circuit 6 (see an arrow F in FIG. 2).

The scanning line drive circuit 4 starts scanning the display panel 2 in response to the gate start pulse signal received from the timing controller 10, and sequentially applies a selected voltage to each of the scanning signal lines G in accordance with the gate clock signal. Based on the source start pulse signal received from the timing controller 10, the signal line drive circuit 6 stores, in a register, image data of each pixel which data has been supplied thereto, and writes the image data to each of the data signal lines S in the display panel 2 in accordance with a subsequent source latch strobe signal.

The voltage source generating circuit 13 generates Vdd, Vdd2, Vcc, Vgh, and Vgl which are necessary for causing the circuits in the display device 1 to operate. Then, the voltage source generating circuit 13 supplies Vcc, Vgh, and Vgl to the scanning line drive circuit 4, supplies Vdd and Vcc to the signal line drive circuit 6, supplies Vcc to the timing controller 10, and supplies Vdd2 to the common electrode drive circuit 8.

(Electric Power Consumption in Conventional Display Device)

The following description discusses an issue of electric power consumption in a conventional display device. A display device having a general resolution WSVGA (1024 RGB×600) is taken as an example. Such a display device requires 1024×3 (RGB)=3072 analog amplifiers to be provided in a signal line drive circuit. Each of the analog amplifiers is an element for supplying a data signal to a data signal line. A constantly stationary electric current of approximately 0.01 mA flows through each of the analog amplifiers so that an output capability is secured.

It follows that a total amount of constantly stationary electric currents of the respective 3072 analog amplifiers is approximately 30.7 mA. Normally, a voltage source (Vdd) to be supplied to a signal line drive circuit is approximately 10 V. Therefore, the signal line drive circuit consumes electric power of 10 V×30.7 mA=307 mW. This value, which accounts for a great percentage of an amount of electric power consumption in the entire display device, serves as one of major causes of prevention of achievement of lower electric power consumption in the display device.

(Electric Power Consumption in the Display Device 1)

The display device 1 of the present embodiment operates at lower electric power than the conventional display device described above. The following description discusses this point with reference to FIG. 3.

(a) of FIG. 3 shows an internal configuration, especially an output part of the signal line drive circuit 6. The signal line drive circuit 6 includes a plurality of analog amplifiers 14 (see FIG. 3). The plurality of analog amplifiers 14 are provided for the respective data signal lines S. Accordingly, the signal line drive circuit 6 in accordance with the present embodiment includes M analog amplifiers 14. Namely, the plurality of analog amplifiers 14 and the data signal lines S are identical in number.

The signal line drive circuit 6 further includes an AMP_Enable signal line for supplying an AMP_Enable signal to each of the plurality of analog amplifiers 14. The AMP_Enable signal line is connected to the control signal output section 12 of the timing controller 10. The plurality of analog amplifiers 14 are connected in parallel in the signal line drive circuit 6.

Vdd, which is a voltage source supplied from the voltage source generating circuit 13 in the display device 1 (described earlier), is used to cause the circuits in the display device 1 including the signal line drive circuit 6 to operate. Each of the plurality of analog amplifiers 14 also operates in response to a supply thereto of Vdd.

At a predetermined timing, the control signal output section 12 of the timing controller 10 supplies, to each of the plurality of analog amplifiers 14 of the signal line drive circuit 6, the AMP_Enable signal which is a control signal for specifying an operating condition of the plurality of analog amplifiers 14. Specifically, in accordance with a timing at which a first horizontal sync signal Hsync is outputted, the control signal output section 12 causes a voltage of the AMP_Enable signal to be an H value (a high value), and then causes the voltage to be an L value (low value) during a period before a second sync signal Hsync following the first sync signal Hsync becomes H. The plurality of analog amplifiers 14 operate when the AMP_Enable signal has an H value, whereas the plurality of analog amplifiers 14 are suspended when the AMP_Enable signal has an L value.

(Scanning Period and Non-Scanning Period)

The display device 1 displays 60-frame images per second in the display panel 2. Accordingly, one (1) frame period is approximately 16.7 ms. Since the display device 1 has a resolution of 1024×600 pixels, 600 scanning signals G are scanned in one (1) frame period. Assuming that a vertical retrace period is equivalent to 5 horizontal periods, one (1) horizontal period is approximately 27.5 μs.

In order to drive the liquid crystal panel 2, the display device 1 divides one (1) horizontal period into a scanning period and a non-scanning period. In the scanning period, the display device 1 causes an analog amplifier 14 to operate by causing the AMP_Enable signal to have an H value. Further, the display device 1 turns on a gate of a TFT by causing a scanning signal to have Vgh. The scanning period is equal to a time required for writing to a pixel electrode of a voltage necessary for display. According to the present embodiment, the scanning period accounts for approximately one third of one (1) horizontal period.

In the non-scanning period, the display device 1 suspends the analog amplifier 14 by causing the AMP_Enable signal to have an L value. Further, the display device 1 turns off the gate of the TFT by causing the scanning signal to have Vgl. According to the present embodiment, the non-scanning period accounts for approximately two thirds of one (1) horizontal period since the non-scanning period is a period other than the scanning period in one (1) horizontal period.

(Signal Waveform)

The following description specifically discusses waveforms of various signals during driving of the display panel 2. For convenience of explanation, driving with respect to an equivalent circuit (see FIG. 4) is taken as an example. FIG. 4 briefly shows a circuit structure of the display panel 2. A TFT is provided for each pixel in the display panel 2, and a drain of the TFT is connected to a pixel electrode (not shown) (see FIG. 4). The display panel 2 is provided with a common electrode (COM) which is provided so as to face the pixel electrode and cause a liquid crystal layer to be sandwiched between the common electrode and the pixel electrode.

FIG. 1 shows waveforms of various signals during driving of the display panel 2 of the display device 1 in accordance with the embodiment of the present invention. The display device 1 receives Hsync for each horizontal period. In sync with this Hsync, the display device 1 changes a voltage of the AMP_Enable signal from an L value to an H value. This causes an analog amplifier 14 of the signal line drive circuit 6 to switch from a non-operating condition to an operating condition (a normal condition). The AMP_Enable signal sustains the H value during application to a data signal line S (i) of a voltage necessary for display.

Next, in sync with the Hsync, the display device 1 changes a voltage to be supplied to the first scanning signal line G from Vgl (an L value) to Vgh (an H value). This causes a gate of the TFT of a pixel connected to the first scanning signal G (1) to turn on.

Subsequently, in sync with the Hsync, the display device 1 supplies, for each of the data signal lines S, a data signal from an analog amplifier 14 connected to a corresponding data signal line S (i). This allows the voltage necessary for display to be supplied to each of the data signal lines S and then written to a pixel electrode via the TFT.

The display device 1 which has completed the application of the voltage necessary for display changes the value of the AMP_Enable signal from the H value to the L value in one (1) horizontal period. This causes the analog amplifier 14 to be in the non-operating condition. In this case, an output of the analog amplifier 14 and the data signal line S (i) are disconnected. The data signal line S (i) may be electrically floating or may be connected to Vdd, for example (specifically described later). Since a voltage waveform of the data signal line S (i) is determined depending on a state in this case, the voltage waveform is shown in FIG. 1 not by a solid line indicative of a determinate waveform but by a dotted line indicative of an indeterminate waveform. Since the voltage necessary for display has been applied to the pixel electrode, no great influence occurs to display.

A time required for completion of the application of the voltage necessary for display is determined depending mainly on properties of the TFT. Accordingly, it is only necessary that the time be found based on a design value and the like of the TFT and the time thus found be used by storing the time in the display device 1. According to the present embodiment, the time is one third of one (1) horizontal period.

A gate voltage is changed from Vgh to Vgl at a timing at which the value of the AMP_Enable signal changes from the H value to the L value. This causes a state of the gate of the TFT from an on state to an off state.

After the first one (1) horizontal period has passed, the display device 1 receives a subsequent Hsync. Each pixel in one (1) row which pixel is connected to the second or later scanning signal line G is driven as in the case of each pixel in one (1) row which pixel is connected to the first scanning signal line G. However, since the display device carries out polarity reversal driving with respect to the display panel 2, a voltage to be applied to the data signal line S (i) reverses its polarity every time a scanning signal line G to be scanned changes. For example, in FIG. 1, a data signal which changes its polarity from a negative polarity to a positive polarity is applied to the data signal line S (i) when the first scanning signal line G (1) is scanned, whereas a data signal which changes its polarity from a positive polarity to a negative polarity is applied to the data signal line S (i) when the second scanning signal line G (2) is scanned.

(Operation Effect)

As described earlier, the display device 1 includes: the signal line drive circuit 6 provided with a circuit (the analog amplifier 14) through which a stationary electric current flows; and the control signal output section 12 for suspending operation of the analog amplifier 14 during a period from a start time after application to the data signal line (i) of the voltage necessary for display is completed in one (1) horizontal period to an end time in the one (1) horizontal period.

According to the arrangement, the stationary electric current flowing through the analog amplifier 14 is cut off during the period (i.e., non-scanning period) from the start time to the end time in the non-scanning period. As a result, an average electric current consumption has a value shown by an arrow P in FIG. 1. This value is much smaller than a value of an average electric current consumption (see an arrow P' in FIG. 11) in a conventional display device. Accordingly, the display device 1 yields an effect of achieving lower electric power consumption as compared to the conventional display device.

According to the display device 1, a period in which the analog amplifier 14 is suspended is completed in one (1) horizontal period. Specifically, the display device 1 causes the analog amplifier 14 to be in the operating condition in each horizontal period without fail, so as to supply the voltage necessary for display to the data signal line S (i). This causes a refresh period of each pixel to be equal to one (1) frame period. In other words, an image is refreshed in all the frame periods. This prevents a frequency at which an image is refreshed from being lowered. Therefore, a smooth moving image can be displayed.

For comparison, the following description discusses an average electric current consumption in a conventional signal line drive circuit. FIG. 11 shows signal waveforms during driving by a conventional display device of a display panel. The conventional display device sustains an operating condition of each analog amplifier during one (1) horizontal period. A gate voltage sustains an H value (sustains a gate-on state) during one (1) horizontal period.

According to the conventional display device, a constantly stationary electric current flows through the each analog amplifier in one (1) horizontal period. Namely, no control is carried out for cutting off a stationary electric current in a given period in one (1) horizontal period. As a result, an average electric current consumption has a value shown by the arrow P' in FIG. 11. This value is much larger than the value of the average electric current consumption (see the arrow P in FIG. 1) in the display device 1 of the present invention. Unlike the display device 1 of the present invention, the conventional display device thus yields no effect of achieving lower electric power consumption.

(Case of the Display Device 1 Including Gradation Amplifier)

According to the present invention, the number of analog amplifiers 14 and the number of data signal lines S do not necessarily need to be identical. For example, a method of providing the analog amplifiers 14 for respective gradations allows the analog amplifiers 14 to be smaller in number than the data signal lines S. The following description discusses the present example with reference to FIG. 5.

FIG. 5 partially shows an arrangement of a display device 1*a* including analog amplifiers 14 which are as many as gradations. According to the present example, a signal line drive circuit 6 of the display device 1*a* includes 256 analog amplifiers (gradations) 14. Each of the analog amplifiers 14 supplies, to a data signal line S (i), a corresponding one of V0 through V255 which are voltages for displaying respective gradations 0 (zero) through 255. An output voltage is predetermined for each of the analog amplifiers 14, and there is only one analog amplifier 14 that outputs an identical voltage.

Outputs of the respective analog amplifiers 14 can be connected to all the data signal lines S in the display panel 2. Accordingly, an identical voltage can be supplied from one (1) analog amplifier 14 to each of the arbitrary number of data signal lines S. During driving of the liquid crystal panel 2, the data signal line S (i) connected to each pixel in a selected scanning signal line G is connected to an analog amplifier 14 which outputs a voltage in accordance with a gradation displayed by the each pixel.

Each of the analog amplifiers 14 can receive an AMP_Enable signal (described earlier). Accordingly, the display device 1*a* (see FIG. 5) can also carry out a driving method described with reference to FIG. 1. Namely, since 256 analog amplifiers 14 are all in the non-operating condition in the non-scanning period in one (1) horizontal period, a stationary electric current can be reduced in the non-scanning period, so that lower electric power consumption can be achieved.

(Destination to which Data Signal Line is Connected in the Non-scanning Period)

A destination to which the data signal line S (i) may be undetermined in the non-scanning period. Alternatively, the data signal line S (i) may be connected to any voltage source. The following description discusses these points with reference to FIG. 6.

(a) of FIG. 6 shows a state in which the data signal line S (i) is electrically floating in the non-scanning period. According to the example shown in (a) of FIG. 6, an analog amplifier 14 and the data signal line S (i) are disconnected in the non-scanning period (period in which the AMP_Enable signal has an L value), and a destination to which the data signal line S (i) is undetermined. Namely, the data signal line S (i) is electrically floating.

(b) of FIG. 6 shows a state in which the data signal line S (i) is connected to a common Vdd in the non-scanning period. FIG. 7 shows waveforms of various signals in a case where the data signal line S (i) is connected to the common voltage source. According to the examples shown in (b) of FIG. 6 and FIG. 7, the analog amplifier 14 and the data signal line S (i) are disconnected in the non-scanning period, and each of the data signal lines S (i) is connected to the common voltage source (Vdd). According to this, after the scanning period is completed, i.e., after a value of the AMP_Enable signal has changed from an H value to an L value, a voltage supplied to the data signal line S (i) decreases from its peak value by a given value, and the voltage thus having decreased is stably sustained (see an arrow Q in FIG. 7). This allows a voltage supplied to the data signal line S to be stable in the non-scanning period, so that stable display can be sustained.

Note that the data signal line S (i) may be connected not only to any voltage source (Vdd) but also to a ground (GND) or a common node in the non-scanning period. In either case, it is possible to obtain an effect of allowing a voltage supplied to the data signal line S to be stable in the non-scanning period.

(Example of Differentiating Timing)

(a) of FIG. 8 shows waveforms of various signals in a case where a timing at which an analog amplifier 14 is restored from a non-operating condition to an operating condition and a timing at which a gate of a TFT is turned on. (b) of FIG. 8 shows waveforms of various signals in a case where the gate of the TFT is turned on at a timing later than the timing at which the analog amplifier 14 is restored from the non-operating condition to the operating condition.

According to the display device 1, in a case where the analog amplifier 14 is restored from the non-operating condition to the operating condition, a certain amount of time is necessary for allowing the analog amplifier 14 to operate normally. Therefore, in a case where the timing at which the analog amplifier 14 is restored and the timing at which the gate of the TFT is turned on are identical, a state of a signal to be supplied from the analog amplifier 14 to a data signal line S becomes unstable in a period K in (a) of FIG. 8 (see 30 in (a) of FIG. 8). This may cause an originally unintended voltage to be applied to a pixel.

In view of the circumstances, the display device 1 is preferably arranged such that the gate of the TFT is turned on (i.e., a voltage of a scanning signal is changed from Vgl to Vgh) at the timing later than the timing at which the analog amplifier 14 is restored from the non-operating condition to the operating condition. Specifically, a time from a timing at which a value of the AMP_Enable signal is changed from an L value to an H value to a timing at which the voltage of the scanning signal is changed from Vgl to Vgh is set to a value more than 0 μs. This causes the gate of the TFT to turn on after a time has passed in which the analog amplifier 14 is restored from the non-operating condition and then becomes stable. As a result, a regular voltage can be applied to a pixel.

(Division of all Analog Amplifiers 14)

The present invention may be arranged such that all the analog amplifiers 14 are divided into a plurality of analog amplifier groups and switch from the non-operating condition to the operating condition at a different timing for each of the plurality of analog amplifier groups. The following description discusses this example with reference to FIG. 9 and FIG. 10.

(a) of FIG. 9 shows a configuration of a signal line drive circuit 6*a* including an analog amplifier group 20 made up of a plurality of analog amplifiers 14 and an analog amplifier group 21 made up of a plurality of analog amplifiers 14. (b) of FIG. 9 shows a configuration of a signal line drive circuit 6*b* including the analog amplifier group 20 made up of the plurality of analog amplifiers 14 and a configuration of a signal line drive circuit 6*c* including the analog amplifier group 21 made up of the plurality of analog amplifiers 14.

According to the example shown in (a) of FIG. 9, the display device 1 includes one (1) signal line drive circuit 6*a*. All the analog amplifiers 14 are divided into two analog amplifier groups 20 and 21 in the signal line drive circuit 6*a*. According to the example shown in (b) of FIG. 9, the display device 1 includes two signal line drive circuits 6*b* and 6*c*. In the signal line drive circuit 6*b*, a plurality of analog amplifiers 14 constitute one (1) analog amplifier group 20. Meanwhile, in the signal line drive circuit 6*c*, a plurality of analog amplifiers 14 constitute one (1) analog amplifier group 21.

In either the configuration of (a) of FIG. 9 or the configuration of (b) of FIG. 9, the analog amplifier group 20 is controlled by an AMP_Enable signal 1, and the analog amplifier group 21 is controlled by an AMP_Enable signal 2.

(a) of FIG. 10 shows waveforms of various signals in a case where all the analog amplifiers 14 simultaneously switch from the non-operating condition to the operating condition. (b) of FIG. 10 shows waveforms of various signals in a case where a part of all the analog amplifiers 14 switches from the non-operating condition to the operating condition at a timing different from a timing at which the remaining part of the analog amplifiers 14 switches from the non-operating condition to the operating condition.

According to the display device 1, a rush electric current flows through a voltage source line of each of the analog amplifiers 14 when the analog amplifiers 14 switch from the non-operating condition to the operating condition. In a case where all the analog amplifiers 14 simultaneously switch to the operating condition, the rush electric current is multiplied by the number of analog amplifiers 14. This causes a large rush electric current to flow through the voltage source line and may consequently cause a drop in voltage source (see (a) of FIG. 10).

Meanwhile, each of the configurations shown in (a) of FIG. 9 and (b) of FIG. 9 allows control as shown in (b) of FIG. 10. According to the example of (b) of FIG. 10, after a value of the AMP_Enable signal 1 switches from an L value to an H value and then a period T1 passes, a value of the AMP_Enable signal 2 switches from an L value to an H value. Thereafter, a voltage of a scanning signal switches from Vgl to Vgh after a period T2 passes. According to this, the rush electric current flows through the analog amplifier group 20 at a timing earlier than a timing at which the rush electric current flows through the analog amplifier group 21. Accordingly, the example of (b) of FIG. 10 allows a peak value of the rush electric current flowing through the voltage source line to be smaller than the case of (a) of FIG. 10.

(Additional Description)

The invention is not limited to the description of the embodiments above, but may be altered within the scope of the claims. An embodiment based on a proper combination of technical means disclosed in different embodiments is encompassed in the technical scope of the invention.

In the non-scanning period, in a case where at least one of all the analog amplifiers 14 in the signal line drive circuit 6 is suspended, it is possible to obtain an effect of reducing electric power consumption while allowing display of a moving image. Suspending all the analog amplifiers 14 is desirable since such operation can reduce the largest amount of electric power consumption.

The start time in the non-scanning period may be not only immediately after the application of the voltage necessary for display is completed but also slightly after the end time. Meanwhile, the end time in the non-scanning period may be not only a time when one (1) horizontal period is completed but also slightly before that time. Namely, a period of any length from a time when the scanning period is completed to a time when one (1) horizontal sync period is completed can be the non-scanning period.

Operation of a member other than an analog amplifier 14 may be suspended in the non-scanning period. Namely, capability of any circuit group (element group) which includes the analog amplifier 14 and through which a stationary electric current flows may be lowered. Such a circuit group is exemplified by a DAC (Digital-Analogue-Converter) circuit section which determines a voltage for each gradation and a Vdd generating circuit section.

The display device 1 can achieve lower electric power consumption by lowering capability (driving capability) of the analog amplifier 14 in the non-scanning period (described above). However, complete suspension (turning-off) of the analog amplifier 14 allows obtainment of the highest effect of achieving lower electric power consumption. Accordingly, the display device 1 can yield an effect of the present invention also by "suspending the analog amplifier 14" instead of "lowering the driving capability of the analog amplifier 14" in the non-scanning period. Note that a state in which the capability of the analog amplifier 14 is the lowest corresponds to a state in which the analog amplifier 14 is suspended".

(Summary of the Present Invention)

It is preferable that: the circuit through which the stationary electric current flows include a plurality of analog amplifiers each supplying a data signal voltage to a corresponding one of the at least one data signal line; and the capability control means lower capability of at least one of the plurality of analog amplifiers from the start time to the end time.

According to the arrangement, a constantly stationary electric current which flows through each of the plurality of analog amplifiers can be reduced in the non-scanning period.

It is preferable that the capability control means lower capability of all the plurality of analog amplifiers from the start time to the end time.

The arrangement causes all the plurality of analog amplifiers to be in a low capability state in the non-scanning period. This allows for maximum reduction of electric power consumption.

The display device is preferably arranged to further include a scanning line drive circuit which, at the start time, outputs a signal for turning off a gate of a switching element connected to a pixel electrode.

According to the arrangement, a change in voltage supplied to the at least one data signal line can be prevented in the non-scanning period. This enables stable display.

It is preferable that: the plurality of analog amplifiers be divided into a plurality of analog amplifier groups each being made up of a plurality of analog amplifiers; and at a different timing for each of the plurality of analog amplifier groups, the capability control means restore, from a low capability condition to a normal condition, the plurality of analog amplifiers of which the each of the plurality of analog amplifier groups is made up.

The arrangement allows for reduction of a peak value of a rush electric current occurring when the plurality of analog amplifiers are restored to the normal condition. It is preferable that the start time be immediately after the application of the voltage necessary for display is completed.

The arrangement allows for further reduction of electric power consumption.

It is preferable that the end time be when the horizontal period is completed.

The arrangement allows for further reduction of electric power consumption.

It is preferable that the capability control means restore the circuit through which the stationary electric current flows to a normal condition at the end time, and the display device further include a scanning line drive circuit which, after the end time, outputs a signal for turning on a gate of a switching element connected to a pixel electrode.

According to the arrangement, the gate of the switching element is turned on after a time has passed in which the circuit through which the stationary electric current is restored from the low capability condition and then becomes stable. As a result a regular voltage can be applied to a pixel.

It is preferable that, from the start time to the end time, the capability control means disconnect the at least one data signal line from the plurality of analog amplifiers, and connect the at least one data signal line to a voltage source.

According to the arrangement, a voltage supplied to the at least one data signal line is stable in the non-scanning period. Therefore, stable display can be sustained.

The display device is arranged such that the display device is a liquid crystal display device.

According to the arrangement, a liquid crystal display device can be made which allows for reduction of electric power consumption while being capable of displaying a moving image without causing flickering.

The embodiments discussed in the foregoing description of embodiments and concrete examples serve solely to illustrate the technical details of the present invention, which should not be narrowly interpreted within the limits of such embodiments and concrete examples, but rather may be applied in many variations within the spirit of the present invention, provided such variations do not exceed the scope of the patent claims set forth below.

INDUSTRIAL APPLICABILITY

A display device in accordance with the present invention can be extensively used as various display devices such as a liquid crystal display device, an organic EL display device, and electronic paper.

REFERENCE SIGNS LIST

1 Display device
1*a* Display device
2 Display panel
4 Scanning line drive circuit
6 Signal line drive circuit
8 Common electrode drive circuit
10 Timing controller
12 Control signal output section (Capability control means)
14 Analog amplifier (Circuit through which stationary electric current flows)
S Data signal line
G Scanning signal line

The invention claimed is:

1. A display device comprising:

a signal line drive circuit provided with a circuit through which a stationary electric current flows; and a controller configured to lower a capability of the signal line drive circuit during a period from a start time after a time at which application of a voltage to at least one data signal line for display is completed in a horizontal period, to an end time in the horizontal period, the controller being configured to lower the capability of the signal line drive circuit after a corresponding gate voltage is switched from a high value to a low value.

2. The display device as set forth in claim 1, wherein, from the start time to the end time, the controller is configured to suspend the signal line drive circuit.

3. The display device as set forth in claim 1, wherein the signal line drive circuit includes a plurality of analog amplifiers provided for the respective at least one data signal line, and the controller is configured to lower the capability of the signal line drive circuit by lowering a capability of at least one of the plurality of analog amplifiers from the start time to the end time.

4. The display device as set forth in claim 3, wherein the controller is configured to lower the capability of the signal line drive circuit by lowering a capability of all the plurality of analog amplifiers from the start time to the end time.

5. The display device as set forth in claim 3, wherein the plurality of analog amplifiers are divided into a plurality of analog amplifier groups each being made up of a plurality of analog amplifiers; and at a different timing for each of the plurality of analog amplifier groups, the from a low capability condition to a normal condition, the plurality of analog amplifiers of which the each of the plurality of analog amplifier groups is made up.

6. The display device as set forth in claim 1, further comprising;

a scanning line drive circuit which, at the start time, is configured to output a signal for turning off a gate of a switching element connected to a pixel electrode.

7. The display device as set forth in claim 1, wherein the start time is immediately after a time at which the application of the voltage necessary for display is completed.

8. The display device as set forth in claim 1, wherein the end time is when the horizontal period is completed.

9. The display device as set forth in claim 1, wherein the controller is configured to restore the signal line drive to a normal condition at the end time, and said display device further comprises a scanning line drive circuit which, after the end time, is configured to output a signal for turning on a gate of a switching element connected to a pixel electrode.

10. The display device as set forth in claim 1, wherein, from the start time to the end time, the controller is configured to, disconnect the at least one data signal line from the signal line drive circuit, and connect the at least one data signal line to a voltage source.

11. The display device as set forth in claim 1, wherein the display device is a liquid crystal display device.

12. A method of driving a display device including a signal line drive circuit provided with a signal line drive circuit through which a stationary electric current flows, said method comprising;

lowering a capability of the signal line drive circuit during a period from a start time after a time at which application of a voltage to at least one data signal line for display is completed in a horizontal period, to an end time in the horizontal period, the controller being configured to lower the capability of the signal line drive circuit after a corresponding gate voltage is switched from a high value to a low value.

* * * * *